US005213071A

United States Patent [19]

Iwata et al.

[11] Patent Number: 5,213,071

[45] Date of Patent: May 25, 1993

[54] SUPPORT STRUCTURE FOR CAM SHAFTS

[75] Inventors: Noriyuki Iwata; Naoyuki Yamagata, both of Hiroshima; Tatsuya Uesugi, Higashi-Hiroshima; Taiji Matsubara, Hatsukaichi, all of Japan

[73] Assignee: Mazda Motor Corporation, Hiroshima, Japan

[21] Appl. No.: 947,638

[22] Filed: Sep. 21, 1992

[30] Foreign Application Priority Data

Sep. 20, 1991 [JP] Japan ..... 3-242030

[51] Int. Cl.[5] ..... F01L 1/04

[52] U.S. Cl. ..... 123/90.27; 123/90.34; 123/193.5; 123/196 M

[58] Field of Search ..... 123/90.27, 90.34, 90.37, 123/90.38, 90.6, 193.5, 196 M

[56] References Cited

U.S. PATENT DOCUMENTS

| | | | |
|---|---|---|---|
| 4,497,289 | 2/1985 | Bortolussi | 123/193.5 |
| 4,593,657 | 6/1986 | Aoi et al. | 123/90.27 |
| 4,612,885 | 9/1986 | Yoshikawa | 123/90.27 |
| 4,658,769 | 4/1987 | Horio et al. | 123/90.27 |
| 4,823,747 | 4/1989 | Wagner et al. | 123/90.27 |
| 4,915,066 | 4/1990 | Koshimoto et al. | 123/90.27 |
| 4,991,549 | 2/1991 | Sugiura | 123/196 M |
| 5,121,718 | 6/1992 | Saito | 123/90.27 |
| 5,143,034 | 9/1992 | Hirose | 123/90.34 |

*Primary Examiner*—E. Rollins Cross
*Assistant Examiner*—Weilun Lo
*Attorney, Agent, or Firm*—Keck, Mahin & Cate

[57] ABSTRACT

The support structure for cam shafts including an intake cam shaft and an exhaust cam shaft, a pair of intake cams per a cylinder formed side by side on the intake cam shaft, a pair of exhaust cams per a cylinder formed side by side on the exhaust cam shaft and having longer interval therebetween than that of the intake cams, a cam cap forming an upper portion of the support structure for the cam shafts and an upper wall portion of a plug hole for inserting the ignition plug, a cam carrier forming a lower portion of the support structure for the cam shafts and a lower wall portion of the plug hole, and fasteners for fastening the cam cap to an engine block. The fasteners are disposed both at longitudinally opposite sides of the pair of intake cams and between the pair of the exhaust cams.

4 Claims, 4 Drawing Sheets

SUPPORT STRUCTURE FOR CAM SHAFTS

BACKGROUND OF THE INVENTION

The invention relates to a support structure for use of cam shafts disposed in an internal-combustion engine.

RELATED ART STATEMENT

In a double overhead cam shaft (DOHC) type engine, conventionally cam shafts are disposed in a upper space in a cylinder head and rotatably supported by a cam carrier and a cam cap. This type of a support structure for cam shafts is disclosed in Japanese Utility Model Publication No. 53-643, for instance, which was laid open on Nov. 6, 1974 and published Jan. 11, 1978.

In such a DOHC type engine, a cam shaft assembly usually including oil mists and/or blow-by gas therein is generally spaced away from an ignition plug through which a high voltage current passes. A plug hole for inserting an ignition plug is frequently formed in order to keep the ignition plug away from the cam shaft assembly. However, when the plug hole is defined by a cam carrier and a cam cap, it is difficult to ensure adequate sealing at a contact surface between a cam carrier and a cam cap.

SUMMARY OF THE INVENTION

It is an object of the present invention to provide a support structure for cam shafts ensuring adequate sealing at a contact surface, in particular around plug holes, between a cam cap and a cam carrier.

The invention provides a support structure for cam shafts including an intake cam shaft disposed in a cylinder head, an exhaust cam shaft disposed opposite the intake cam shaft with an ignition plug being disposed between the shafts, a pair of intake cams per a cylinder formed side by side on the intake cam shaft, a pair of exhaust cams per a cylinder formed side by side on the exhaust cam shaft, the pair of exhaust cams having longer interval therebetween than that of the intake cams, a cam cap forming an upper portion of the support structure for the cam shafts and an upper wall portion of a plug hole for inserting the ignition plug, a cam carrier forming a lower portion of the support structure for the cam shafts and a lower wall portion of the plug hole, and fasteners for fastening the cam cap to an engine block. The fasteners are disposed both longitudinally at opposite sides of the pair of intake cams and between the pair of the exhaust cams.

In a preferred embodiment, the fasteners are disposed symmetrically about the intake and exhaust cam shafts.

In another preferred embodiment, the fasteners fasten the cam cap to the cam carrier.

In still another preferred embodiment, the fasteners fasten the cam cap to the cylinder head through the cam carrier thereby the cam carrier is supported between the cam cap and the cylinder head.

The advantages obtained by the aforementioned support structure will be described hereinbelow.

In the support structure for cam shafts in accordance with the invention, a cam carrier and a cam cap of intake and exhaust cam shafts in DOHC type engine are fastened to each other by means of fastener means so that they form a support or a bearing structure. The cam cap and cam carrier cooperate to form a plug hole into which an ignition plug is to be inserted. The intake cam shaft has a pair of intake cams formed side by side thereon. The pair of intake cams have a relatively short interval therebetween. Similarly, the exhaust cam shaft has a pair of exhaust cams formed side by side thereon. The pair of exhaust cams have longer interval therebetween than that of the intake cams. A support for the intake cam shafts is formed at longitudinally opposite sides of the pair of intake cams. Accordingly, similarly to the support for the cam shafts, fastener means is provided at longitudinally opposite sides of the pair of intake cams to fasten the cam carrier to the cam cap. On the other hand, a support for the exhaust cam shafts is formed between the pair of exhaust cams. Fastener means provided where the support is formed fastens the cam carrier to the cam cap. Thus, the supports for both of the cam shafts are disposed adjacent to the cams. This arrangement increases support strength given by the supports. The increase in support strength given by the supports in turn enhances sealing ability in the plug hole formed by the cam carrier and the cam cap. In addition, since the intake cams are disposed symmetrically with the exhaust cams with respect to the ignition plug, the fastener means are disposed symmetrically with respect to the plug hole, accordingly. This arrangement also enhances sealing ability between the cam carrier and the cam cap.

The above and other objects and advantageous features of the present invention will be made apparent from the following description made with reference to the accompanying drawings.

DESCRIPTION OF THE PREFERRED EMBODIMENTS

Figure 1:
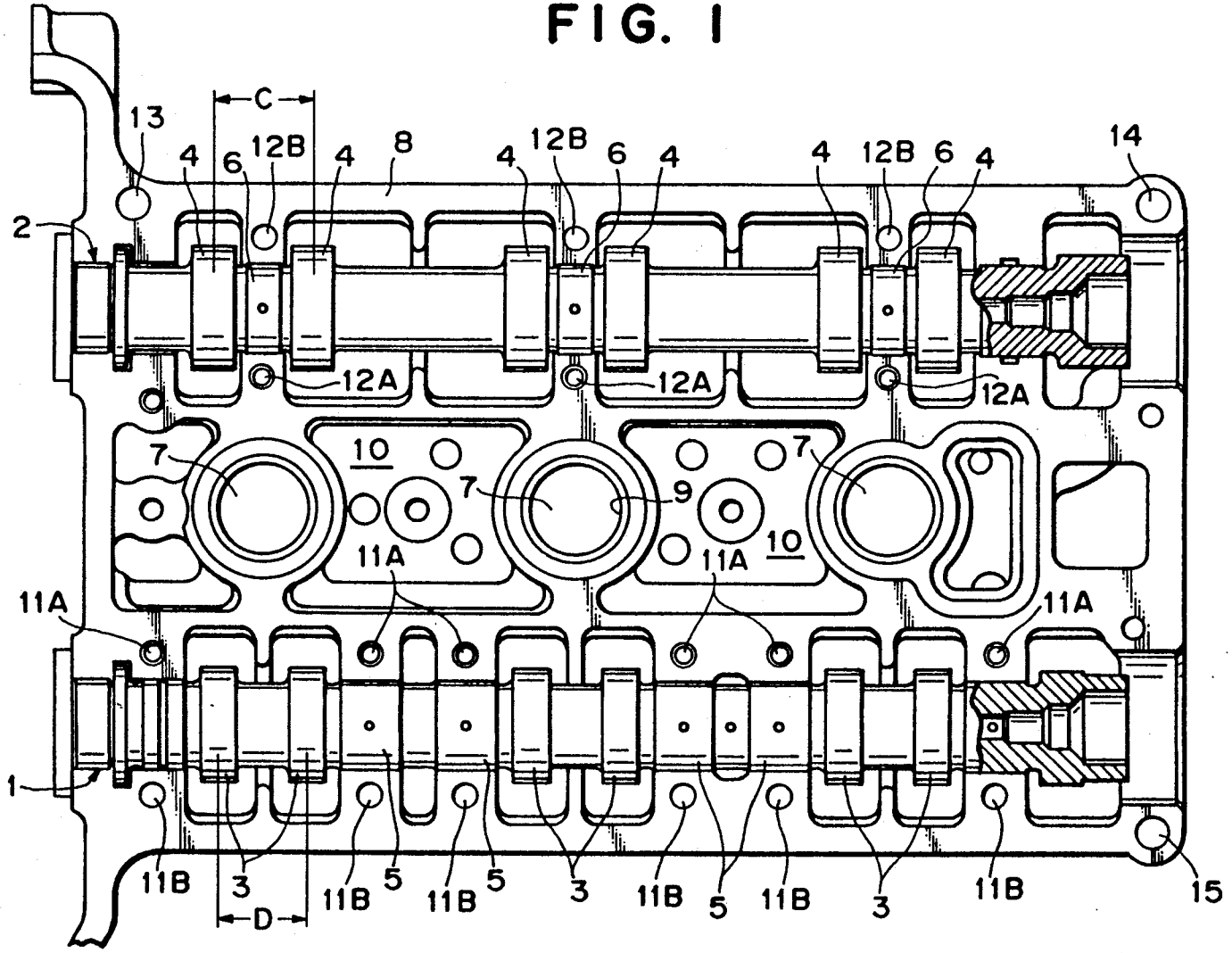
FIG. 1 is a top plan view illustrating the lower portion of the support structure supporting the cam shafts thereon.
Figure 2:
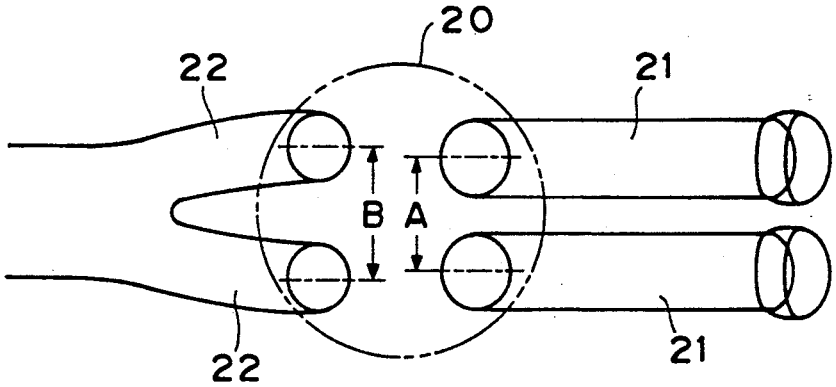
FIG. 2 is a plan view illustrating the layout of intake and exhaust ports of an engine to which the support structure in accordance with the invention is suitably applied.

A preferred embodiment in accordance with the invention will be explained hereinbelow with reference to drawings. The support structure in accordance with the invention is applied to a DOHC V-type engine having two banks each including three cylinders therein. A structure for operating valves in one of banks is illustrated in FIG. 1. FIG. 2 is an explanatory view of a cylinder of an engine to which the structure illustrated in FIG. 1 is preferably applied.

Figure 3:
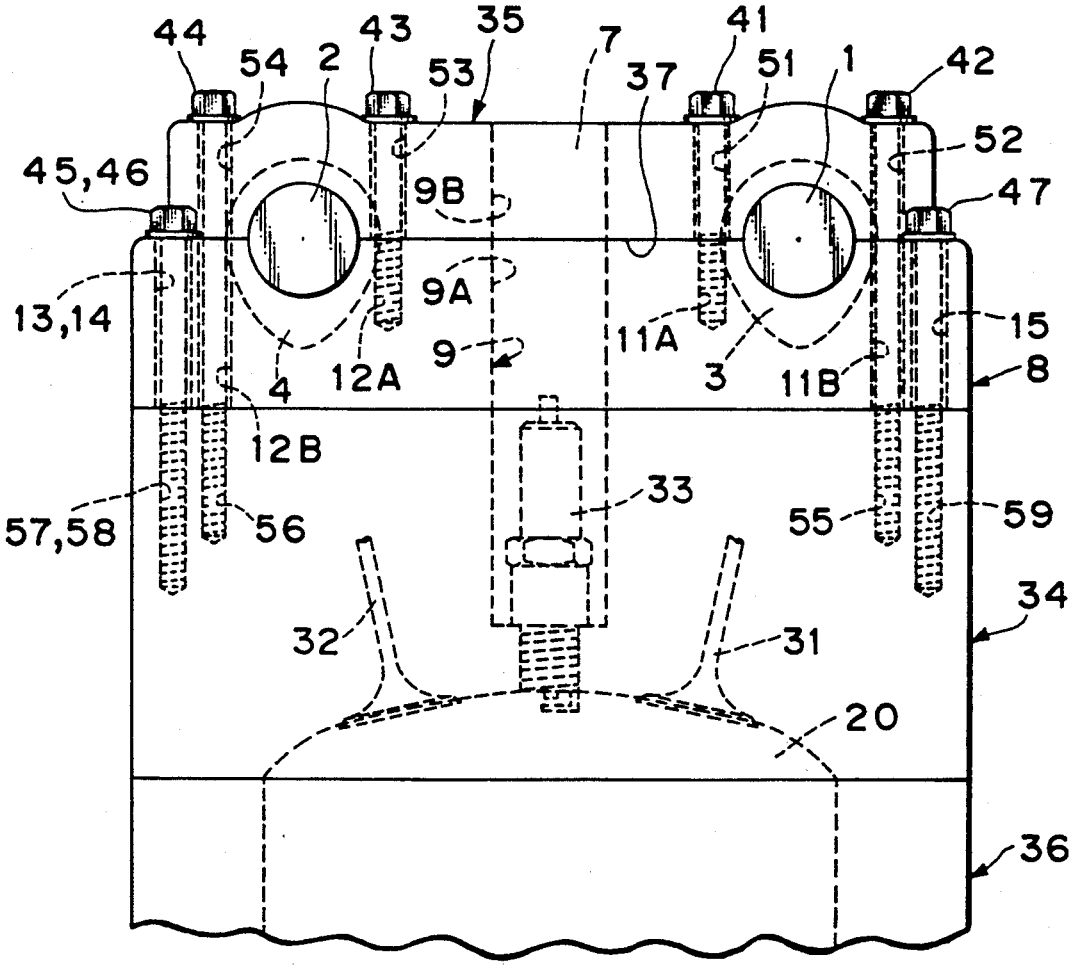
FIG. 3 is a front view of an engine to which the support structure in accordance with the invention is applied.
Figure 4:
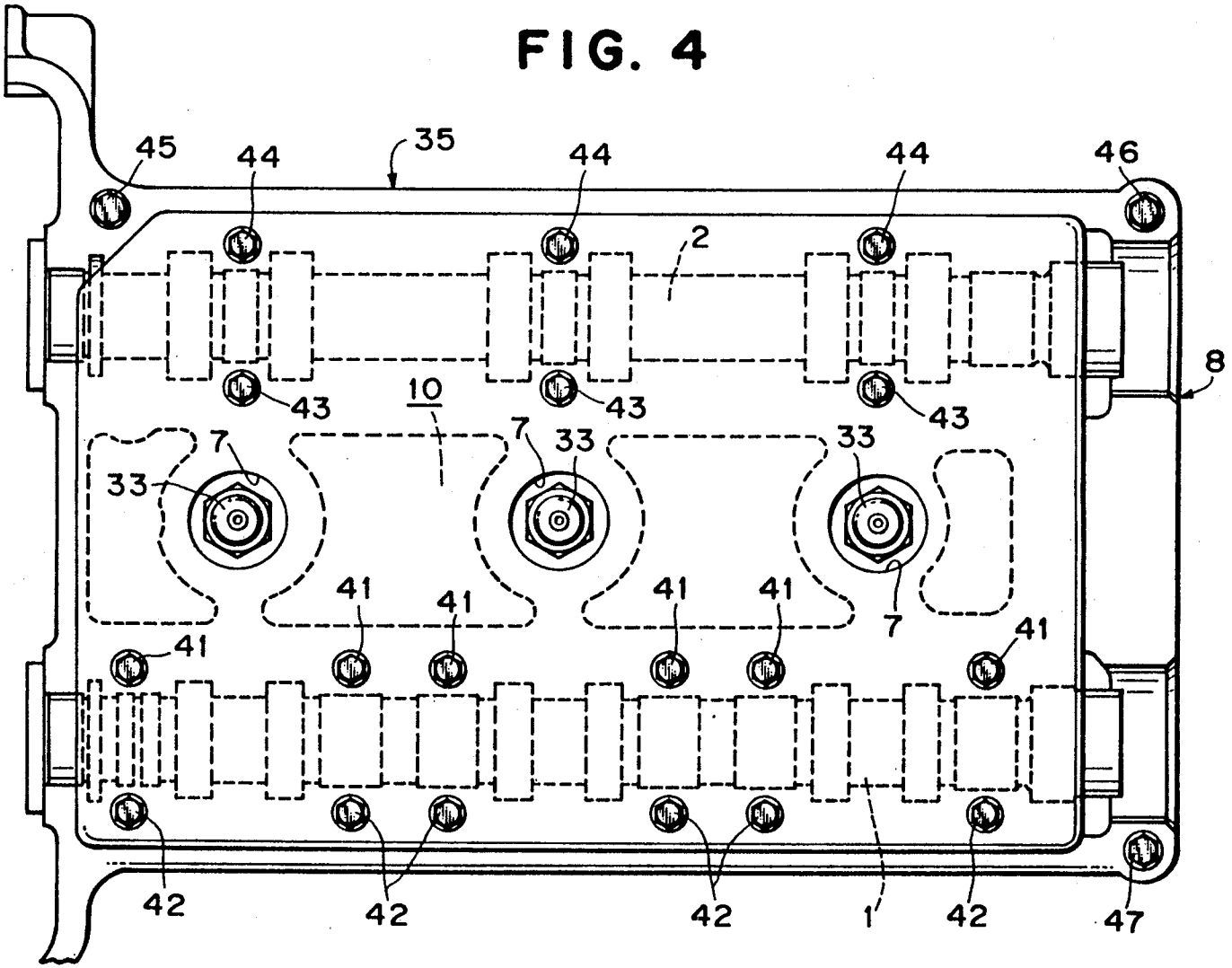
FIG. 4 is a top plan view of the support structure.

As shown in FIG. 1, the structure in the present embodiment includes an intake cam shaft 1 and an exhaust cam shaft 2. As shown in FIG. 3, each cylinder has a pair of intake valves 31 and a pair of exhaust valves 32 (only one of them are shown in FIG. 3), and a pair of intake cams 3 and a pair of exhaust cams 4 for operating the valves 31, 32. As shown in FIG. 2, a pair of intake ports 21 which opens to a combustion chamber 20 has a shorter interval A therebetween than an interval B between a pair of exhaust ports 22 ($B>A$). This arrangement wherein a pairs of intake ports 21 and exhaust ports 22 are provided and the interval A is set shorter than the interval B facilitates to produce an intake tumble flow to be introduced into the combustion chamber 20. In accordance with this arrangement, the pair of exhaust cams 4 has a longer interval C therebetween than an interval D between the pair of intake cams 3 (C>D). The intake cam shaft 1 has journal portions 5 disposed at longitudinally opposite sides of the pair of the intake cams 3, while the exhaust cam shaft 2 has journal portions 6 disposed between the pair of exhaust cams 4.

Each cylinder has a plug hole 7 at the center thereof into which an ignition plug 33 (see FIG. 3) is to be inserted. The cam shafts 1, 2 are supported at their lower side by a cam carrier 8 to be secured to a cylinder head 34 which is fixed on a cylinder block 36, and covered by a cam cap 34 to be supported at their upper side so that the cam shafts 1, 2 can rotate. The cam carrier 8 provides a lower portion of a support for supporting the journal portions 5, 6 of the shafts 1, 2, and a lower wall portion 9A of a plug hole wall 9 comprising the plug hole 7. The cam cap 35 provides an upper wall portion 9B of the plug hole wall 9. This arrangement provides the cam carrier 8 and the cam cap 35 with enhanced rigidity. Thus, the plug hole 7 is formed by vertically securing the cam cap 35 to the cam carrier 8 both of which are separately manufactured.

Spaces between the plug holes 7 provide passages 10 for passing blow-by gas therethrough. Therefore, a contact surface 37 (see FIG. 3) between the cam carrier 8 and the cam cap 35 both of which cooperate to form the plug hole wall 9 is required to have sealing ability to prevent blow-by gas from penetrating the plug hole 7.

As illustrated in FIG. 1, the cam carrier 8 has a plurality of pairs of a threaded hole 11A and a through hole 11B. The holes 11A and 11B are disposed adjacent to the journal portions 5 and symmetrically with respect to the intake cam 1. The cam carrier 8 also has a plurality of pairs of a threaded hole 12A and a through hole 12B which are disposed adjacent to the journal portions 5 and symmetrically with respect to the exhaust cam 2. As shown in FIG. 3, the cam cap 35 has through holes 51, 52, 53 and 54 in alignment with the holes 11A, 11B, 12A and 12B, respectively. The cylinder head 34 has threaded holes 55 in alignment with the holes 11B and 52, and threaded holes 56 in alignment with the holes 12B and 54. The cam cap 35 is fastened to the cam carrier 8 by means of fastener means or bolts 41 and 43 inserted into the through holes 51 and 53 and screwed into the threaded holes 11A and 12A, and bolts 42 and 44 inserted into the through holes 52, 11B and 54, 12B and screwed into the threaded holes 55 and 56.

As shown in FIG. 1, the cam carrier 8 also has three through holes 13, 14, 15 at corners thereof. As shown in FIG. 3, the cylinder head 34 has three threaded holes 57, 58, 59 in alignment with the through holes 13, 14, 15, respectively. The cam carrier 8 is fastened to the cylinder head 34 by means of fastener means or bolts 45, 46, 47 inserted into the through holes 13, 14, 15 and screwed into the threaded holes 57, 58, 59.

The cam cap 35 may be fastened to the cam carrier 8 by means of fastener means disposed in the vicinity of the plug holes 7 in order to enhance sealing around the plug holes 7. However, this arrangement cannot provide adequate support strength for supporting the cam shafts 1, 2 and thus deteriorates the sealing. In the support structure in accordance with the invention, the fastener means or bolts are disposed both at longitudinally opposite sides of the pair of intake cams 3 and between the pair of exhaust cams 4, and adjacent to the journal portions 5 and 6. This arrangement provides both adequate support strength for supporting the cam shafts and enhanced sealing.

As aforementioned with reference to the preferred embodiments, the present invention has many advantages. In the support structure in accordance with the invention, the journal portions of the cam shafts are disposed as adjacent as possible to the cams through which external forces exert on the cam shafts, and the cam carrier is fastened to the cam cap by means of the bolts as adjacent as possible to the journal portions of the cam shafts. Thus, the support structure provides adequate support strength for supporting the cam shafts and enhanced sealing at the contact surface around the plug hole wall between the cam cap and the cam carrier.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A support structure for cam shafts comprising:
an intake cam shaft disposed in a cylinder head;
an exhaust cam shaft disposed opposite to the intake cam shaft with an ignition plug being disposed between the shafts;
a pair of intake cams per a cylinder formed side by side on the intake cam shaft;
a pair of exhaust cams per a cylinder formed side by side on the exhaust cam shaft and having a longer interval therebetween than that of the intake cams;
a cam cap forming an upper portion of the support structure for the cam shafts and an upper wall portion of a plug hole for inserting the ignition plug;
a cam carrier forming a lower portion of the support structure for the cam shafts and a lower wall portion of the plug hole; and
fastener means for fastening the cam cap to an engine cylinder head, said fastener means being disposed both at longitudinally opposite sides of the pair of intake cams and between the pair of exhaust cams.

2. A support structure for cam shafts in accordance with claim 1 wherein said fastener means are disposed symmetrically about the shafts.

3. A support structure for cam shafts in accordance with claim 1 wherein said fastener means fastens the cam cap to the cam carrier.

4. A support structure for cam shafts in accordance with claim 1 wherein said fastener means fastens the cam cap to the cylinder head through the cam carrier thereby the cam carrier is supported between the cam cap and the cylinder head.

* * * * *